US006929572B2

(12) United States Patent
Morrow et al.

(10) Patent No.: US 6,929,572 B2
(45) Date of Patent: Aug. 16, 2005

(54) LACROSSE HEAD HAVING INWARD EXTENDING FLAPS

(75) Inventors: David Morrow, Metamora, MI (US); Jesse Hubbard, New York, NY (US)

(73) Assignee: Warrior Lacrosse, Inc., Warren, MI (US)

( * ) Notice: Subject to any disclaimer, the term of this patent is extended or adjusted under 35 U.S.C. 154(b) by 0 days.

(21) Appl. No.: 10/605,640

(22) Filed: Oct. 15, 2003

(65) Prior Publication Data

US 2004/0116216 A1 Jun. 17, 2004

Related U.S. Application Data

(60) Provisional application No. 60/418,956, filed on Oct. 15, 2002.

(51) Int. Cl.[7] ..... A63B 59/02; A63B 65/12

(52) U.S. Cl. ..... 473/513; D21/724

(58) Field of Search ..... 473/513, 512, 473/514, 528, 543, 505; D21/724

(56) References Cited

U.S. PATENT DOCUMENTS 5,938,550 A * 8/1999 Hexemer et al. ..... 473/513
6,506,132 B1 * 1/2003 Brine, III et al. ..... 473/513
6,520,875 B1 * 2/2003 Crawford ..... 473/513
6,676,547 B1 * 1/2004 Morrow et al. ..... 473/513
2002/0160865 A1 * 10/2002 Brine et al. ..... 473/513

* cited by examiner

*Primary Examiner*—Gregory Vidovich
*Assistant Examiner*—M. Chambers
(74) *Attorney, Agent, or Firm*—John S. Artz; Artz & Artz PC

(57) ABSTRACT

A lacrosse head (10) with a substantially narrow pocket and lower manufacturing costs is provided. In one embodiment, this lacrosse head (10) includes a one-piece integral frame element (18) comprised of a base portion (24), a pair of sidewalls (20) diverging from the base portion (24), and a scoop portion (22) connecting the sidewalls (20) opposite the base portion (24). This lacrosse head (10) further includes a pair of flaps (12) coupled to the sidewalls (20) by an overmolding process. These flaps (12) extend inwardly and rearwardly from their respective sidewalls (20) toward a centerline (26) of the lacrosse head (10). Each flap (12) has a series of holes (28) formed therein for receiving a netting (14) and attaching the netting (14) thereto. As a result, these flaps (12) narrow the width of the pocket and decrease lateral ball movement within the lacrosse head (10).

22 Claims, 3 Drawing Sheets

LACROSSE HEAD HAVING INWARD EXTENDING FLAPS

CROSS REFERENCE TO RELATED APPLICATIONS

The present application claims priority to U.S. Provisional Application Ser. No. 60/418,956, entitled "LACROSSE HEAD HAVING DOWNWARD EXTENDING FLAPS," filed on Oct. 15, 2002, the disclosure of which is incorporated by reference herein.

BACKGROUND OF INVENTION

The present invention relates generally to a lacrosse head, and more particularly to a lacrosse head having inward extending flaps for enhancing ball control, improving throwing accuracy, and decreasing manufacturing cycle time and costs associated therewith.

Current lacrosse heads are comprised of plastic material and have a one-piece construction. This one-piece construction includes a base portion, a pair of sidewalls diverging from the base portion, and a scoop portion connecting the sidewalls opposite to the base portion. The sidewalls typically have a series of holes formed therein for weaving a netting therethrough and attaching the netting to the lacrosse head.

Game regulations, which are determined by the NCAA or other governing body, typically require that the lacrosse heads are sized according to predetermined standards. For example, NCAA's 2003 regulations require that the maximum lateral distance between the sidewalls measures between 6.5 and 10 inches. Ordinarily, manufacturers produce lacrosse heads so that the widest distance between the sidewalls is adjacent to the scoop portion.

Maximizing the distance between the sidewalls increases the width of the pocket and can assist a player in catching the lacrosse ball. However, a substantially wide pocket can also hinder the player's ball handling skills and diminish his throwing accuracy. Specifically, the wide pocket can provide a substantial amount of room for the ball to roll from one sidewall of the lacrosse head to the other sidewall. As a result, the lacrosse ball can strike a sidewall with sufficient force to accidentally bounce out of the lacrosse head. In addition, the substantially wide pocket can also allow the lacrosse ball to stray from the lacrosse head's centerline as the player shoots or passes the lacrosse ball. This feature is disadvantageous because a player's throwing accuracy can diminish if the lacrosse ball does not follow the lacrosse head's center line as the player shoots or passes the ball.

Furthermore, the substantially wide pockets typically require a significant amount of netting attached to the lacrosse head. This amount of netting can result in high material costs, as well as a substantially long manufacturing cycle time.

It is therefore desirable to provide a lacrosse head that improves ball retention, enhances throwing accuracy, and decreases manufacturing cycle time, as well as costs associated therewith.

SUMMARY OF INVENTION

It is therefore one advantage of the present invention to provide a lacrosse head that decreases lateral ball movement within the head and improves ball retention.

It is another advantage of the present invention to provide a lacrosse head that decreases lateral ball movement within the head and enhances a player's accuracy in passing and shooting the lacrosse ball.

It is yet another advantage of the present invention to provide a lacrosse head having a decreased amount of netting for minimizing material costs.

It is still another advantage of the present invention to provide a lacrosse head having a decreased amount of netting for minimizing manufacturing cycle time and costs associated therewith.

It is yet another advantage of the present invention to provide a lacrosse head having a pocket bordered by an elastomeric material for cushioning the lacrosse ball and preventing the lacrosse ball from bouncing out of the lacrosse head.

In accordance with the above and other advantages of the present invention, a lacrosse head with a narrower pocket and lower manufacturing costs is provided. In one embodiment, the lacrosse head includes a one-piece integral frame comprised of a base portion, a pair of sidewalls diverging from the base portion, and a scoop portion connecting the sidewalls opposite the base portion. This lacrosse head further includes a pair of flaps coupled to the sidewalls by an overmolding process. These flaps extend inwardly and rearwardly from their respective sidewalls toward a centerline of the lacrosse head. Each flap has a series of holes formed therein for receiving a netting and attaching the netting to the lacrosse head. As a result, these flaps narrow the width of the pocket and decrease lateral ball movement within the lacrosse head.

Other objects and advantages of the present invention will become apparent upon considering the following detailed description and appended claims, and upon reference to the accompanying drawings.

BRIEF DESCRIPTION OF DRAWINGS

For a more complete understanding of this invention, reference should now be made to the embodiments illustrated in greater detail in the accompanying drawings and described below by way of examples of the invention:

FIG. 5 is a cross-sectional view of the lacrosse head shown in FIG. 4, in accordance with another embodiment of the invention; and.

DETAILED DESCRIPTION

Figure 1:
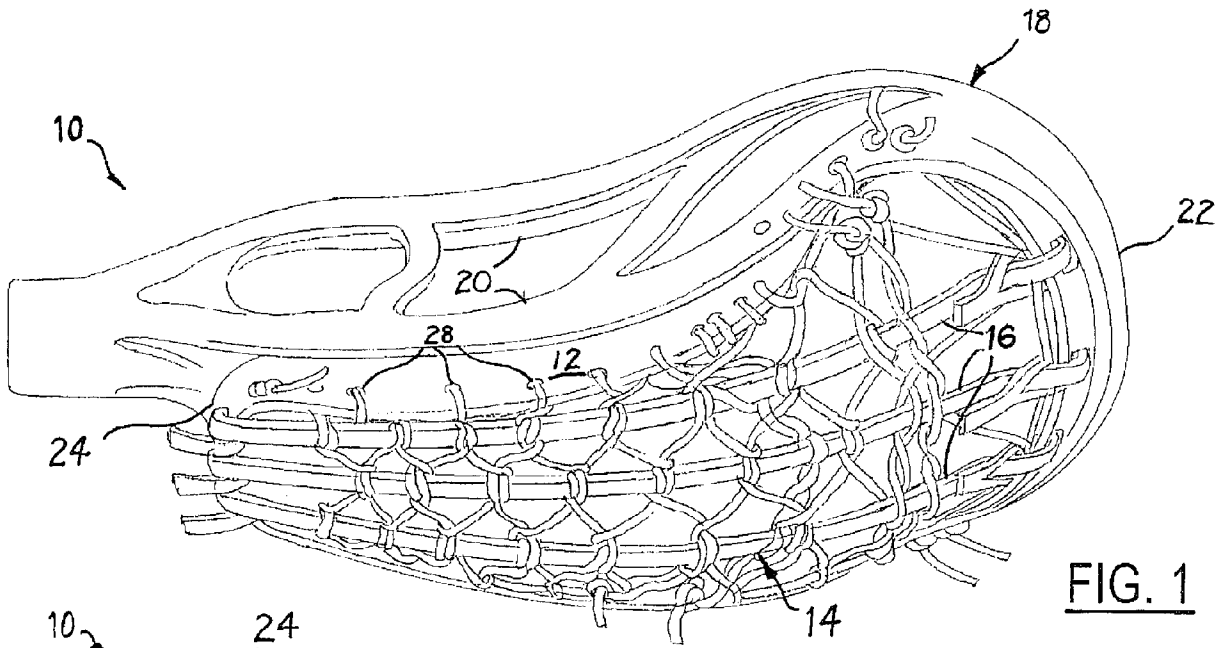
FIG. 1 is a perspective view of a lacrosse head having inwardly and rearwardly extending flaps, in accordance with one embodiment of the present invention.

In the following figures, the same reference numerals will be used to illustrate the same components in the various views.

The present invention is particularly suited for a lacrosse head having a three-piece construction. Specifically, this lacrosse head includes a one-piece integral frame and a pair of opposing flaps attached to the frame. However, it is understood that a variety of other embodiments without one or more of the described features are contemplated as well.

Figure 2:
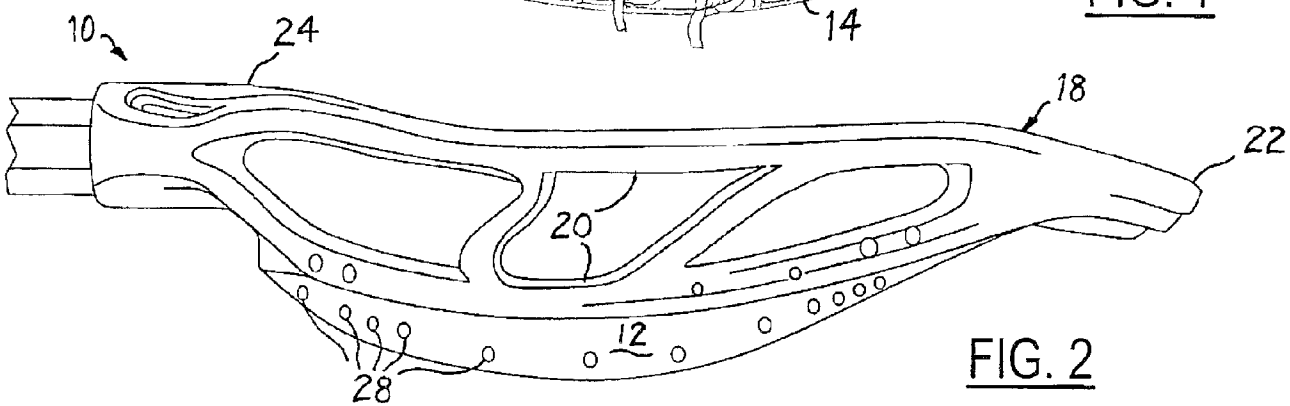
FIG. 2 is a side view of the lacrosse head shown in FIG. 1.
Figure 3:
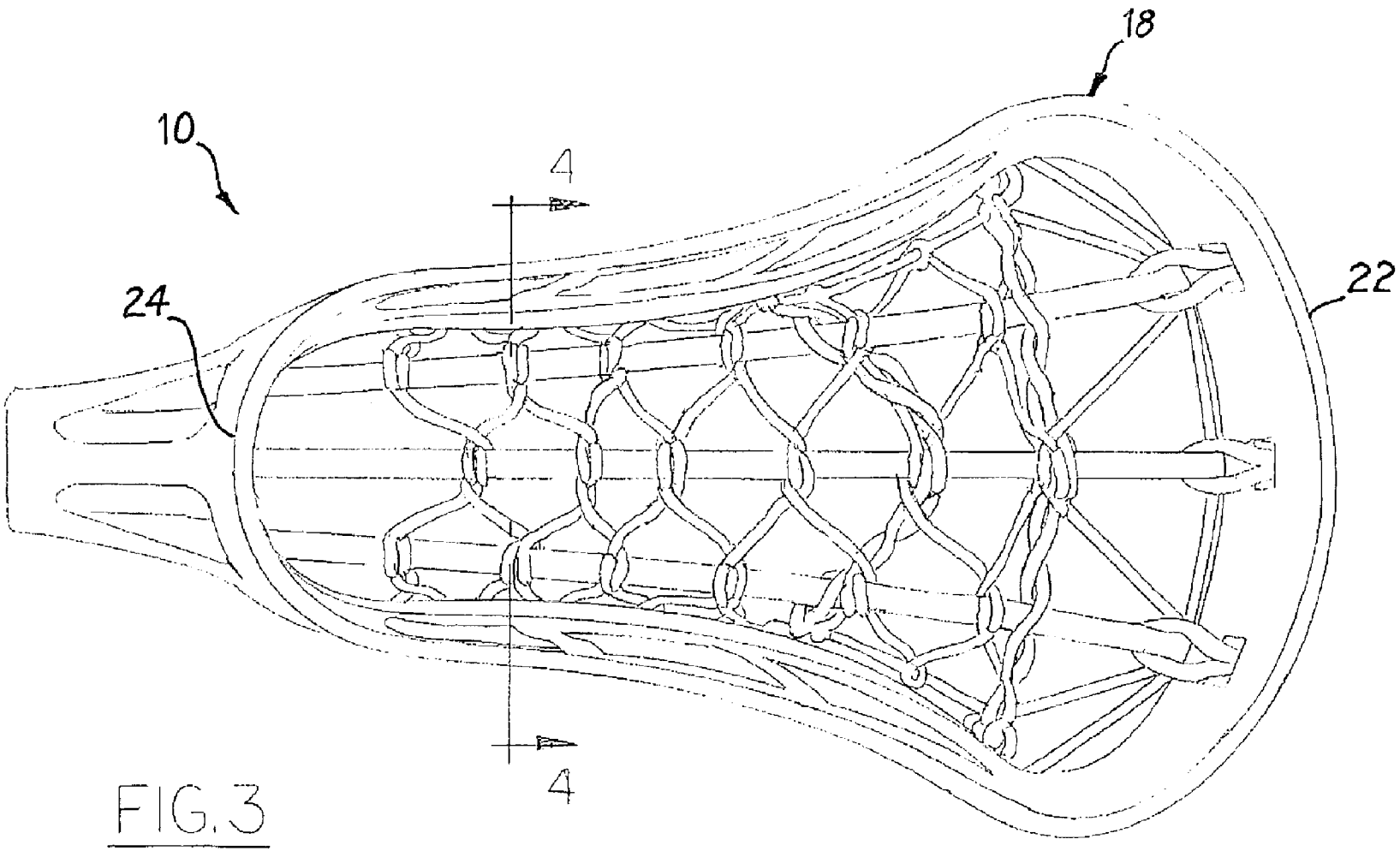
FIG. 3 is a front view of the lacrosse head shown in FIG. 1.

Referring now to FIGS. 1–3, there generally is shown a lacrosse head 10 having a substantially narrow pocket defined by a pair of inwardly and rearwardly extending flaps 12, according to one embodiment of the present invention. As best shown in FIG. 3, the pocket is sufficiently narrow for decreasing the amount of netting typically used to form a pocket of typical lacrosse heads. For example, the lacrosse head 10 can be strung with a traditional pocket having less netting 14, e.g. three or less thongs 16 instead of four thongs ordinarily strung in conventional pockets. The decreased amount of netting 14 can decrease material costs, manufacturing cycle time, and costs associated with the faster production times.

The lacrosse head 10 includes a one-piece integral frame element 18 comprised of a pair of opposing sidewalls 20, a scoop portion 22 extending between and connecting the top ends of the sidewalls 20, and a base portion 24 extending between and connecting the bottom ends of the sidewalls 20. This frame element 18 preferably is comprised of a plastic material and formed by suitable injection molding processes. However, it is understood that the frame element 18 may be constructed from other materials and manufactured by other suitable manufacturing processes as desired. Also, it is contemplated that the frame element 18 can instead be comprised of two or more separate pieces as desired.

Figure 4:
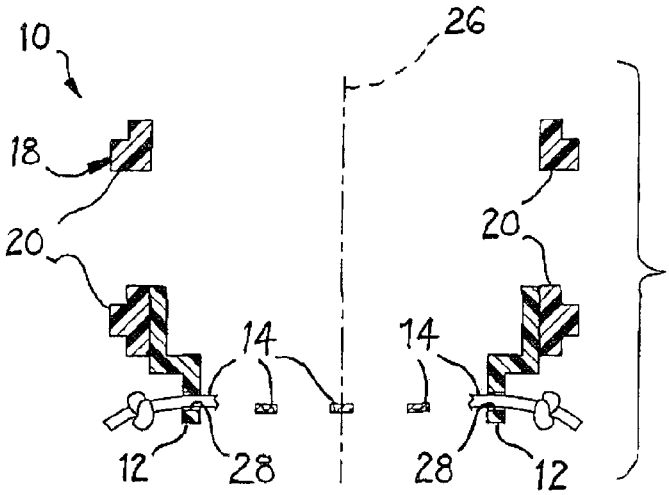
FIG. 4 is a cross-sectional view of the lacrosse head shown in FIG. 2, as taken along line 4—4.

As best shown in FIGS. 2 and 4, the lacrosse head 10 further includes a flap 12 attached to each sidewall 20 for narrowing the width of the lacrosse head's pocket, as compared to conventional lacrosse head pockets. Specifically, each flap 12 extends inwardly from the sidewall 20 toward a centerline 26 (shown in FIG. 3) of the lacrosse head 10. These flaps 12 also extend rearwardly from the sidewalls 20. Moreover, as shown in FIG. 3, each flap 12 is contoured to follow the curve of the corresponding sidewall 20. However, it will be appreciated that the flaps 12 can be contoured according to various other suitable curves as desired.

Each flap 12 has a series of holes 28 formed therein for weaving a netting 14 therethrough and forming a substantially narrow pocket. Specifically, this narrow pocket decreases lateral ball movement within the lacrosse head 10, as compared to conventional lacrosse heads. In this way, the flaps 12 contact the lacrosse ball and prevent it from rolling across the netting 14 with sufficient force that the ball would strike one of the sidewalls 20 and bounce out of the lacrosse head 10. Preferably, the flaps 12 are comprised of an elastomeric material that can cushion the ball as the ball strikes the flap 12.

In addition, the flaps 12 also sufficiently narrow the pocket to channel ball movement closer to the centerline 26 of the lacrosse head 10 as the player shoots or passes the lacrosse ball. It will be appreciated that this feature is particularly beneficial for lacrosse heads strung with shallow pockets because moving the ball along the centerline 26 when throwing the lacrosse ball can allow for improved passing and shooting accuracy. However, it is also understood that the flaps can merely extend rearwardly from the sidewalls, e.g. substantially within the plane of the sidewalls, and not inwardly so as to maintain the original pocket width.

Figure 5:
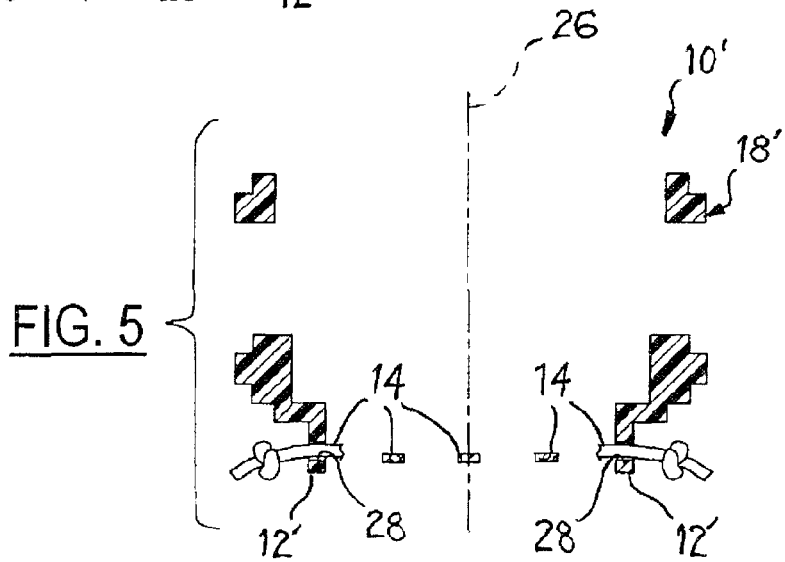

The flaps 12 preferably are coupled to the sidewalls 20 by way of an overmolding process. However, it is contemplated that the flaps 12 can instead be attached to the sidewalls 20 or other portions of the frame element 18 by various other suitable manufacturing processes. With particular attention to another embodiment shown in FIG. 5, it can be seen that the flaps 12" can instead be integral parts of the one-piece integral frame element 18". In other words, the lacrosse head 10" and the flaps 12" are embodied in a one-piece construction.

Figure 6:
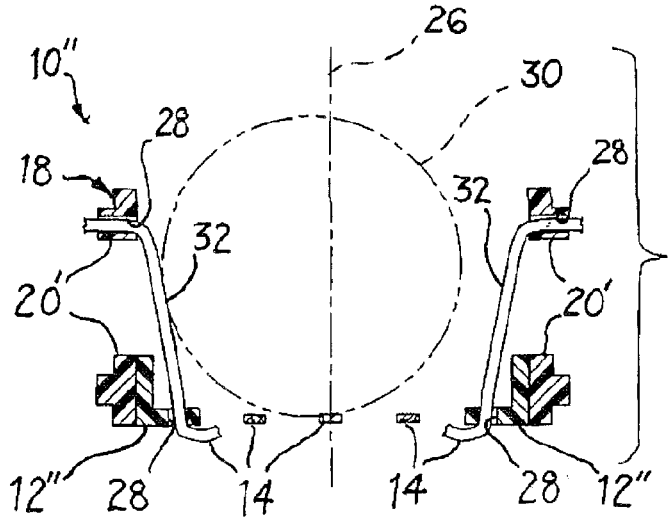
FIG. 6 is a cross-sectional view of the lacrosse head shown in FIG. 4, in accordance with yet another embodiment of the invention.

Referring now to FIG. 6, there is shown a cross-sectional view of a lacrosse head 10" with inwardly extending flaps 12", according to another embodiment of the present invention. In this embodiment, the flaps 12" are utilized in combination with the netting 14 and the sidewalls 20" to decrease the width of the pocket and provide the advantages described above.

Specifically, the flaps 12" only extend inwardly toward the centerline of the lacrosse head 10". In that regard, the flaps 12" do not extend rearwardly from the sidewalls 20". Furthermore, both the sidewalls 20" and the flaps 12" have string holes 28 formed therein for weaving a netting 14 therethrough and attaching the netting 14 to the lacrosse head 10". This netting 14 includes peripheral portions 32, which are positioned along the sides of the pocket, for contacting the lacrosse ball 30 as it rolls toward the sidewalls 20". In this way, the peripheral portions 32 of the netting 14 can retain the lacrosse ball 30 within a relatively narrow region of the lacrosse head 10" closer to the centerline 26 of the lacrosse head 10". In addition, it will be appreciated that the peripheral portions 32 of the netting 14 can also sufficiently cushion the lacrosse ball 30 and prevent the lacrosse ball 30 from bouncing out of the lacrosse head 10".

While the invention has been described in terms of preferred embodiments, it will be understood, of course, that the invention is not limited thereto since modifications may be made by those skilled in the art, particularly in light of the foregoing teachings.

What is claimed is:

1. A lacrosse head, comprising:

a pair of opposing sidewalls each having a top end and a bottom end;

a base portion extending between and connecting said bottom ends of said pair of opposing sidewalls;

a scoop portion extending between and connecting said top ends of said pair of opposing sidewalls;

a pair of separate and distinct opposing flaps coupled to and extending generally inwardly from said pair of opposing sidewalls toward a centerline of the lacrosse head each flap having an upper portion attached to a respective one of said of sidewalls and a lower portion; and a netting coupled to said pair of opposing flaps, such that said lower portions remain spaced apart from one another, and said netting is attached directly to said scoop;

wherein said pair of opposing flaps is utilized for channeling a lacrosse ball into a decreased pocket size area of said netting for improving throwing accuracy and enhancing ball retention of the lacrosse head.

2. The lacrosse head of claim 1 wherein said pair of opposing flaps has a plurality of string holes formed therein for receiving said netting and attaching said netting to the lacrosse head.

3. The lacrosse head of claim 1 wherein said pair of opposing sidewalls, said base portion, and said scoop portion from a one-piece integral frame.

4. The lacrosse head of claim 3 wherein said one-piece integral frame further includes said pair of opposing flaps as integral parts extending from said pair of opposing sidewalls.

5. The lacrosse head of claim 1 wherein said pair of opposing sidewalls includes a plurality of openings for receiving said netting and further attaching said netting to the lacrosse head.

6. The lacrosse head of claim 1 wherein said pair of opposing flaps is contoured substantially similar to said pair of opposing sidewalls.

7. The lacrosse head of claim 1 wherein said netting is at least one of a traditional pocket and a mesh pocket.

8. The lacrosse head of claim 7 wherein said traditional pocket includes less than four thongs.

9. A lacrosse head, comprising:

a pair of opposing sidewalls each having a top end and a bottom end;

a base portion extending between and connecting said bottom ends of said pair of opposing sidewalls;

a scoop portion extending between and connecting said top ends of said pair of opposing sidewalls;

a pair of separate and distinct opposing flaps coupled to and extending generally inwardly from said pair of opposing sidewalls toward a centerline of the lacrosse head, said pair of opposing flaps also extending generally downwardly to a distance below a lower trim of each of said pair of opposing sidewalls; and a netting coupled to said pair of opposing flaps, and said netting attached directly to said scoop;

wherein said pair of opposing flaps is utilized for channeling a lacrosse ball into a decreased pocket size area of said netting for improving throwing accuracy and enhancing ball retention of the lacrosse head.

10. The lacrosse head of claim 9 wherein said pair of opposing flaps has a plurality of string holes formed therein for receiving said netting and attaching said netting to the lacrosse head.

11. The lacrosse head of claim 9 wherein said pair of opposing sidewalls, said base portion, said scoop portion and said pair of opposing flaps form a one-piece integral frame.

12. The lacrosse head of claim 11 wherein said one-piece integral frame is comprised of a plastic material.

13. The lacrosse head of claim 12 wherein said pair of opposing flaps is contoured substantially similar to said pair of opposing sidewalls.

14. The lacrosse head of claim 9 wherein said netting is at least one of a traditional pocket and a mesh pocket.

15. The lacrosse head of claim 9 wherein said traditional pocket includes less than four thongs.

16. A lacrosse head, comprising:

a pair of opposing sidewalls each having a top end and a bottom end;

a base portion extending between and connecting said bottom ends of said pair of opposing sidewalls;

a scoop portion extending between and connecting said top ends of said pair of opposing sidewalls;

a pair of separate and distinct opposing deflecting members respectively extending from said pair of opposing sidewalls by an overmolding process, said pair of opposing deflecting members extending inwardly from said pair of opposing sidewalls toward a centerline of the lacrosse head; and a netting coupled to said pair of opposing deflecting members and positioned therebetween, and said netting attached directly to said scoop;

wherein said pair of opposing flaps is utilized for directing a lacrosse ball into said netting for improving throwing accuracy and enhancing ball retention of the lacrosse head;

wherein said pair of opposing sidewalls, said base portion, and said scoop portion form a one-piece integral frame element.

17. The lacrosse head of claim 16 wherein said pair of opposing deflecting members each are an elastic deformable covering coupled to said at pair of opposing sidewalls for cushioning said lacrosse ball.

18. The lacrosse head of claim 16 wherein said pair of opposing deflecting members has a plurality of string holes formed therein for receiving said netting and attaching said netting to the lacrosse head.

19. The lacrosse head of claim 16 wherein said pair of opposing sidewalls, said base portion, said scoop portion and said pair of opposing deflecting members form a one-piece integral frame.

20. The lacrosse head of claim 19 wherein said pair of opposing deflecting members extends substantially across the length of said pair of opposing sidewalls.

21. A lacrosse head, comprising:

a pair of opposing sidewalls each having a top end and a bottom end;

a base portion extending between and connecting said bottom ends of said pair of opposing sidewalls;

a scoop portion extending between and connecting said top ends of said pair of opposing sidewalls;

a pair of separate and distinct opposing sidewall deflecting members coupled to an inner surface of each of said sidewalls and extending generally inwardly toward a centerline of the lacrosse head;

said pair of opposing sidewall directing members being formed of an elastic deformable covering;

wherein said pair of opposing sidewall directing members decreases the open area between said pair of opposing sidewalls and assist in directing a lacrosse ball into a decreased pocket size area for improving throwing accuracy and enhancing ball retention of the lacrosse head.

22. The lacrosse head of claim 21, wherein said pair of opposing sidewall directing members are coupled to said inner surface of each said sidewalls through an overmolding process.

* * * * *

UNITED STATES PATENT AND TRADEMARK OFFICE

CERTIFICATE OF CORRECTION

PATENT NO. : 6,929,572 B2
DATED : August 16, 2005
INVENTOR(S) : Morrow et al.

It is certified that error appears in the above-identified patent and that said Letters Patent is hereby corrected as shown below:

Column 6,
Line 48, replace "said pair of opposing sidewall directing members" with -- a pair of separate and distinct opposing sidewall deflecting members --.

Signed and Sealed this

Eleventh Day of October, 2005

JON W. DUDAS
*Director of the United States Patent and Trademark Office*